US005383581A

United States Patent [19]

LeMarbe et al.

[11] Patent Number: 5,383,581

[45] Date of Patent: Jan. 24, 1995

[54] STATIC MIXING NOZZLE

[75] Inventors: Edward S. LeMarbe, St. Louis, Mo.; Sao V. Nguyen, Randolph, Mass.

[73] Assignee: Jet Spray Corp., Norwood, Mass.

[21] Appl. No.: 991,440

[22] Filed: Dec. 16, 1992

[51] Int. Cl.[6] ..... B65D 83/00

[52] U.S. Cl. ..... 222/459; 222/129.1; 239/432

[58] Field of Search ..... 222/129.1, 129.2, 129.3, 222/129.4, 459; 239/432

[56] References Cited

U.S. PATENT DOCUMENTS

| | | | |
|---|---|---|---|
| 4,370,062 | 1/1983 | Moody | 239/432 X |
| 4,610,145 | 9/1986 | Arzberger et al. | 222/146.1 X |
| 4,856,676 | 8/1989 | Emody | 222/129.1 X |
| 4,907,725 | 3/1990 | Durham | 222/459 X |
| 5,203,474 | 4/1993 | Haynes | 222/459 X |

*Primary Examiner*—Andres Kashnikow

*Assistant Examiner*—Joseph A. Kaufman

*Attorney, Agent, or Firm*—Wolf, Greenfield & Sacks

[57] ABSTRACT

A static mixing nozzle for use with a dispenser system to thoroughly mix one or more liquids. The static mixing nozzle has a passage with a plurality of baffles arranged in a staggered and alternating pattern throughout the passage. A liquid passing through the static mixing nozzle will strike the plurality of baffles, causing turbulence which mixes the liquid. The baffles prevent laminar flow through the passage. Static mixing nozzles with different numbers of baffles may be used in the dispenser system to accommodate the different types of concentrates and syrups which may be used. The static mixing nozzle may be formed as part of the nozzle or as an insert for the nozzle. The insert is removable and may be formed in parts which can be easily separated and cleaned. The static mixing nozzle does not require any mechanical mixing and operates under standard operating pressures for dispenser systems.

34 Claims, 3 Drawing Sheets

STATIC MIXING NOZZLE

FIELD OF THE INVENTION

This invention relates generally to a nozzle for a dispenser system and more particularly to a static mixing nozzle for a dispenser system which can thoroughly mix highly concentrated viscous material.

BACKGROUND OF THE INVENTION

Post-mix dispenser systems are designed to mix a predetermined ratio of concentrate or syrup with water to produce a desired beverage upon demand. The amount of concentrate or syrup and water dispensed by the system varies, depending upon the type of beverage being produced. Typically, water to concentrate or syrup ratios of five to one or greater involve thick and viscous concentrates or syrups, such as for cola or orange juice. Dispenser systems have had difficulties in sufficiently mixing high ratios of water to concentrate or syrup. Often the resulting beverage has not been thoroughly mixed. Post-mix dispenser systems which must mix these thick and viscous concentrates and syrups have employed a variety of different techniques.

One technique involves adding a mechanical motor to drive one or more rotating blades in a mixing chamber through which the concentrate or syrup and water mixture passes. The rotating blades mix the concentrate or syrup and water to produce the beverage. Unfortunately, this solution requires substantial modifications to the dispenser system to make additional room for the rotating blades and motor.

Another technique of mixing a thick concentrate or syrup with water involves supplying the concentrate or syrup and water to the spout of the dispenser system at higher pressures than typically found in dispenser systems. At higher pressures, the concentrate or syrup and water are more thoroughly mixed within the spout. Unfortunately, to supply the concentrate or syrup and water at higher pressures and to withstand the higher pressures, requires substantial modifications to the dispenser system.

Accordingly, an object of this invention is to provide a nozzle which can thoroughly mix highly concentrated viscous liquids without substantial modifications to the dispenser system.

Another object of this invention is to provide a static mixing nozzle which does not require rotating blades and a motor to mix liquids.

Another object of this invention is to provide a mixing nozzle which operates at normal operating pressures for dispenser systems.

Another object of this invention is to provide a static mixing nozzle which is easy to clean.

Another object of this invention is to provide an inexpensive nozzle for mixing one or more liquids.

SUMMARY OF THE INVENTION

A static mixing nozzle in accordance with this invention has a through passage with a plurality of baffles connected to the passage. The baffles must be arranged in the passage to prevent a direct line of flow through the passage. Preferably, the baffles are connected on alternating sides and in a staggered pattern down the passage. As one or more liquids pass through the passage, the liquids strike the baffles causing turbulence which mixes the liquids. The arrangement and number of baffles in the static mixing nozzle can vary depending upon the amount of turbulence needed. Liquids which are more difficult to mix will need to pass through more baffles.

The static mixing nozzle may be constructed as part of the spout for a dispenser system or may be constructed as a removable insert which fits snugly within the nozzle of the spout. If the removable insert is formed as a one-piece unit, the insert may be disposable. If the removable insert is formed as a two-piece unit, then the halves of the removable insert can be opened and exposed for easy cleaning.

The static mixing nozzle may be used with pre-mix and post-mix dispenser systems. A dispenser system may have a variety of removable static mixing nozzle inserts with different numbers of baffles to accommodate different liquids which must be mixed. Unlike some prior systems, the static mixing nozzle operates at standard operating pressures for dispenser systems and does not require rotating blades and a motor.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 1:
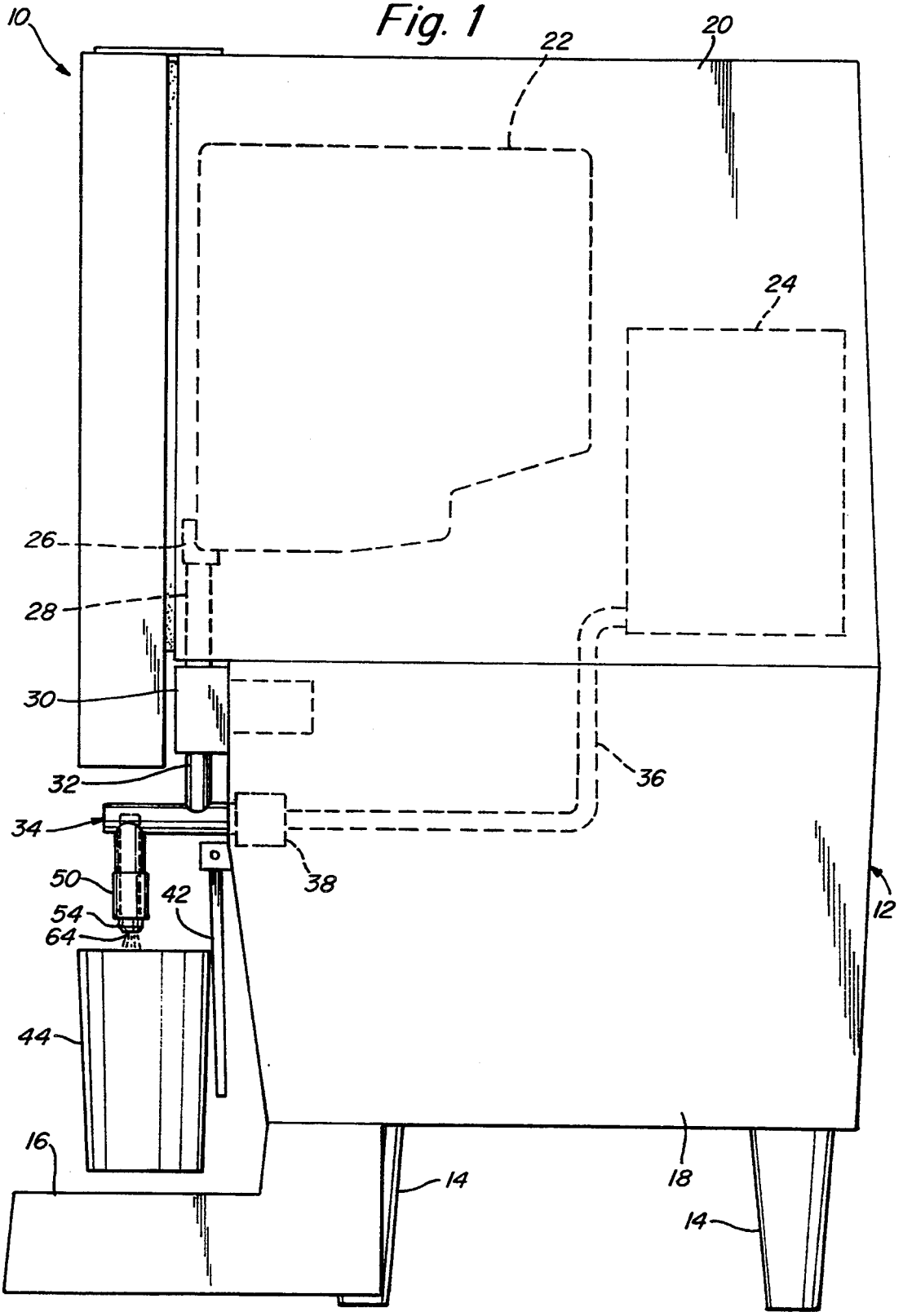
FIG. 1 is a side view of a post mix dispenser with a static mixing nozzle in accordance with the invention.

Referring to the figures, FIG. 1 illustrates a beverage dispenser 10 with a static mixing nozzle in accordance with the invention. The dispenser 10 includes a housing 12 which is supported by four legs 14 attached to the bottom of the housing 12 adjacent the four corners. The bottom of the housing 12 also carries a drip tray 16 along one edge.

The housing 12 includes a lower and upper portion 18 and 20, respectively. The lower portion 18 contains a substantial part of the dispenser refrigeration system including the compressor and the condenser, as well as the dispenser controls and part of the potable water system. The upper portion 20 contains a concentrate container 22, such as the bag-in-box container, and an ice water bath 24. The concentrate container 22 stores concentrate or syrup, such as orange juice concentrate or cola syrup. The ice water bath 24 stores potable water for mixing with the concentrate or syrup.

A concentrate control valve (CCV) 26 and a concentrate line 28 connect the input of a concentrate pump 30 or other type of dispensing mechanism to the concentrate container 22. The output of the concentrate pump 30 is connected to a concentrate intake 32 for a spout 34. When the pump 30 is activated, the pump 30 draws concentrate or syrup from the container 22 and feeds the extracted concentrate to the concentrate intake 32 in the spout 34. The CCV 26, concentrate line 28, and the pump 30 are generally of the type described in U.S. Pat. No. 4,856,676.

Similarly, a water line 36 connects the input of a demand solenoid 38 to the ice water bath 24. The output of the demand solenoid 38 is connected to a potable water intake 40 in the spout 34. When the solenoid 38 is activated, the solenoid 38 permits potable water to be supplied to the water intake 40. The water line 36 and solenoid 38 are generally of the type described in U.S. Pat. No. 4,610,145.

A push handle 42 is connected to the housing 12 below the spout 34. The push handles 42 operates a switch which is part of a control circuit for the pump 30 and the solenoid 38. When the push handle 42 is pressed against the housing 12, the switch is closed completing the control circuit and activating the pump 30 and solenoid 38. When the push handle 42 is released, the switch opens and the pump 30 and solenoid 38 are deactivated Typically, a cup 44 is used to press the push handle against the housing.

Although a push handle 42 is shown, other actuators may be used to operate the switch in the control circuit, such as a push button. The push button could be designed to close the switch and activate the pump 30 and solenoid 36 for a predetermined period of time when pressed and released. Alternatively, the push button could be designed to only close the switch and activate the pump 30 and solenoids 38 while the push button is being pressed.

Figure 2:
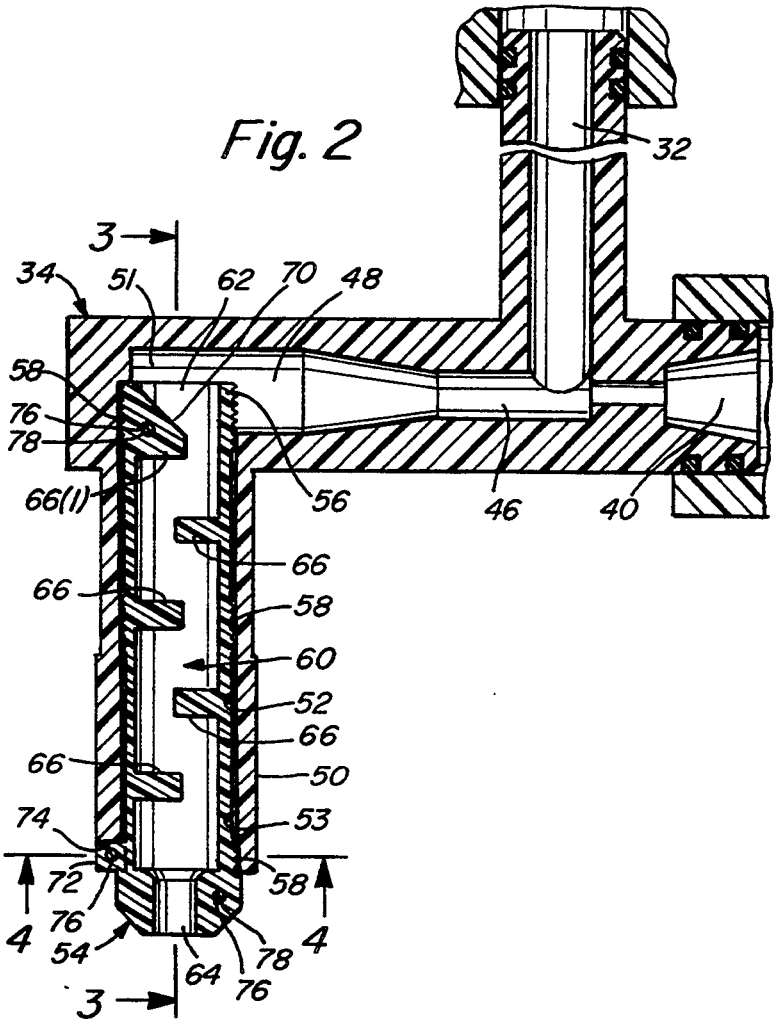
FIG. 2 is a cross-sectional side view of the spout with the nozzle and nozzle insert of FIG. 1.

In FIG. 2, a cross sectional view of the spout 34 is illustrated. The concentrate intake 32 and the water intake 40 are connected to a mixing block 46 at one end of the spout 34. The water intake 40 narrows just before the mixing block 46 to increase the velocity at which water passes through to the block 46. Typically, concentrate or syrup is supplied to the mixing block 46 at about 1-2 PSI and potable water is supplied to the mixing block 46 at about 20 PSI. The mixing block 46 is connected to a horizontal passage 48 which leads to the other end of a spout 34.

A nozzle 50 is connected to the other end of the spout 34 and extends down towards the drip tray 16. The nozzle 50 includes a nozzle passage 52 which extends through the nozzle 50 with one end 51 open to the horizontal passage 48, as illustrated more clearly in FIG. 5. The other end 53 of the passage 48 is open towards the cup 44 and the drip tray 16.

Figure 3:
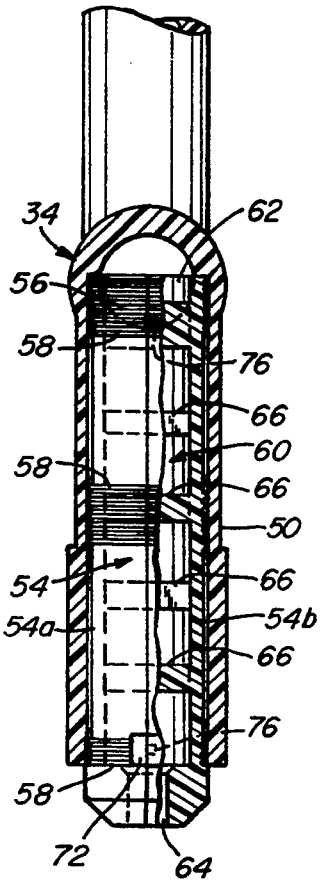
FIG. 3 is a partial cross-sectional end view of the spout with the nozzle and nozzle insert taken along line 3—3 in FIG. 2.
Figure 5:
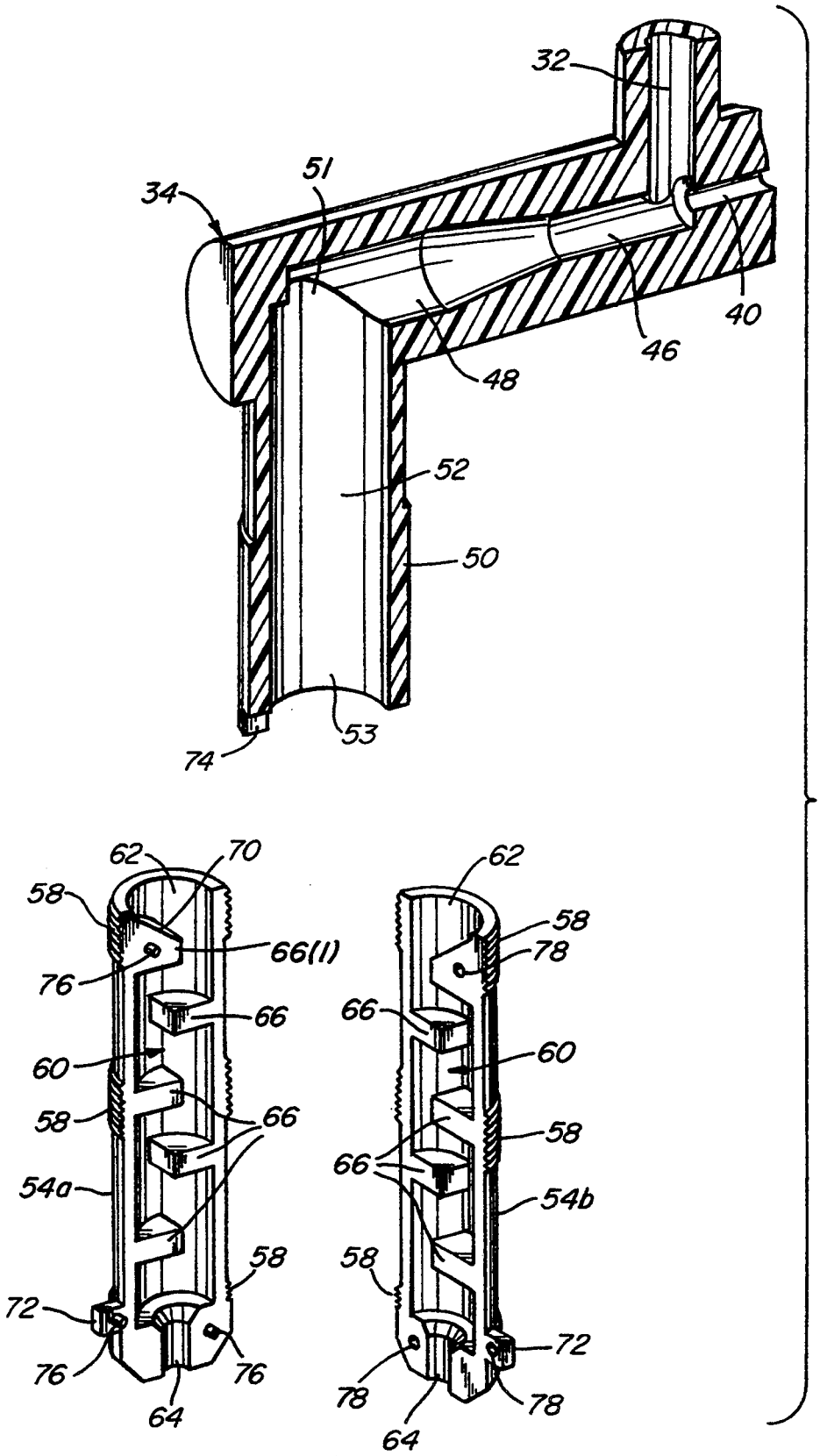
FIG. 5 is an exploded perspective view of the spout with the nozzle and the halves of the nozzle insert.

A nozzle insert 54 is slidably engaged in the nozzle passage 52, with one end 56 of the insert 54 extending partially into the horizontal passage 48. The insert 54 is retained in the passage 48 by sets of ridges 58 which protrude slightly from the outer surface of the insert 54, as illustrated in FIGS. 2, 3 and 5. The ridges 58 engage against the nozzle passage 52 to retain the insert 54 in place. A force of about 50 PSI is necessary to push each set of ridges 58 into the nozzle passage 52. Typically, three sets of ridges 58 are used, although the number of sets of ridges 58 can vary depending upon the amount of force needed to retain the insert 54 in the nozzle passage 52. The insert 54 may also be retained in the nozzle passage 52 by other devices, such as a clamp.

An insert passage 60 extends through the insert 54, with one end 62 of the passage 60 open to the horizontal passage 48 and the other end 64 of the passage 60 open towards the cup 44 and drip tray 16. Typically, the concentrate or syrup and water mixture enters the insert passage 60 at about 22 PSI. This pressure is not sufficient to dislodge the insert 54 from the nozzle passage 52 which required 50 PSI of force to be inserted. Typically, the insert passage 60 will be substantially cylindrical, although the passage 60 can have other shapes. Typically, the opening at the other end 64 is smaller than at the one end 62, to increase the velocity and direct the flow of the mixture as it is dispensed to the cup 44.

Figure 4:
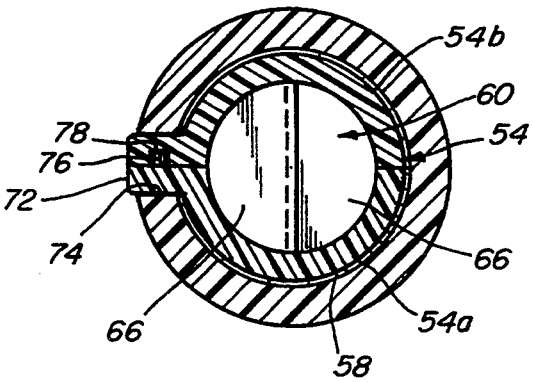
FIG. 4 is a cross-sectional bottom view of the spout with the nozzle and nozzle insert taken along line 4—4 in FIG. 2.

Baffles 66 are connected to the sides of the passage 60. The baffles 66 may be disposed at any distance apart and in any configuration desired, as long as a direct line of flow through the passage 60 is prevented. The particular arrangement for the baffles 66 in the passage 60 will effect the amount of turbulence generated in the passage 60. Preferably, the baffles 66 are connected to alternating sides of the passage 60 in a staggered pattern, with each baffle 66 extending out in a substantially perpendicular direction to surface of the passage 60. This arrangement results in a straight stream of beverage emitted from the other end 64 of the passage 60 to the cup 44. In the preferred arrangement, each baffle 66 is connected to overlap slightly with the baffle 66 just below, as shown more clearly from the bottom view of the spout 34 in FIG. 4.

The number of baffles 66 in the insert passage 60 can vary. Thicker concentrates or syrups will require more baffles 66 in the passage 60 to create sufficient turbulence in the passage 60 to thoroughly mix the concentrates or syrups with water. Typically, a dispenser system 10 will be equipped with a number of different inserts 54, each with a different number of baffles 66, to accommodate the different concentrates and syrups which may be used. Alternatively, a dispenser system 10 may be constructed with a nozzle 50 with a sufficient number of baffles 60 for the thickest concentrate or syrup which may be used. Typically, the insert passage 60 will be constructed with five baffles 66. Five baffles 66 in an insert passage 60 are sufficient to thoroughly mix most orange juice concentrates with water and most cola syrups with water.

The top baffle 66(*l*), adjacent the one end 62 of the insert passage 60 and the other end of the spout 34, is sloped down into the insert passage 60. The sloped face 70 on the top baffle 66(*l*) faces towards the horizontal passage 48 and the mixing block 46. Sloping the top baffle 66(*l*) helps to guide the concentrate or syrup and water mixture in the horizontal passage 48 into the insert passage 60, preventing mixture and pressure from building up in the horizontal passage 48. Excessive pressure in the horizontal passage 48 can restrict the flow of concentrate from a low output pump or dispensing mechanism.

A tab 72 on the outer surface of insert 54 is used to orient the insert 54, particularly the top baffle 66(*l*), within the nozzle passage 52. As described above, the sloped face 70 of the-top baffle 66(*l*) should face the horizontal passage 48 to prevent the buildup of mixture and pressure in the horizontal passage 48. A groove 74 on the nozzle 50 near the other end 53 of the nozzle passage 52 is designed to accommodate the tab 72. Disposing the tab 72 in the groove 74 properly orients the insert 54 and the top baffle 66(*a*). In this embodiment, the tab 72 and the groove 74 each have a substantially square shape, although any geometric shape may be used as long as the tab 72 fits within the matching groove 74. Other devices may also be used to orient the insert 54 in the nozzle passage 60, such as a mark on both the insert 54 and the nozzle 50.

FIG. 5 is an exploded perspective view of the spout 34 and the nozzle insert 54 split along the long axis of the insert 54 into halves 54*a* and 54*b*. Each half 54*a* and 54*b* has part of the five baffles 66 and part of the insert passage 60. The halves 54*a* and 54*b* are oriented and connected together with a set of pins 76 on one half 54*a* and a set of holes 78 on the other half 54*b*. The holes 78 in one half 54*b* are designed to accommodate the pins 76 on the other half 54*a*. The engagement of the pins 76 with the holes 78 holds the halves 54*a* and 54*b* together. Typically, three pins 76 and holes 78 are sufficient to orient and connect the halves 54*a* and 54*b*, although any number of pins 76 and holes 78 could be used. Other devices may also be used to orient the two halves 54*a* and 54*b* together, such as a mark on each half.

Cleaning the insert passage 60 and baffles 66 in the insert 54 shown in FIG. 5 is easy. The insert 54 is simply removed from the nozzle passage 52 and is separated into halves 54*a* and 54*b* by disengaging pins 6 from holes 78. The separation provides access to the insert passage 60 and baffles 66.

Although the insert 14 has been illustrated as a removable two-piece unit with halves 54*a* and 54*b*, the insert 54 may also be made as a removable one-piece unit. Since cleaning with the one-piece unit may be more difficult, the one-piece unit could simply be made disposable after a predetermined amount of use. The insert 54 could also be made as a permanent part of the nozzle 50 for the spout 34.

As shown in FIG. 5, the shape of the nozzle passage 52 is designed to accommodate the shape of the nozzle insert 54. In this embodiment, the passage 52 and the insert 54 are both substantially cylindrical, although the passage 52 and insert 54 could have any shape, such as square or triangular. The spout 34 and the insert 54 may be made from any suitably rigid material, such as plastic.

With the static mixing nozzle and dispenser described above, a thick concentrate or syrup can easily be mixed with water to produce a beverage. To obtain a beverage from the dispenser 10 filled with a thick concentrate or syrup, the cup 44 must press the push handle 42 against the housing 20 to close the switch in the control circuit. With the switch closed, the control circuit can activate the pump 30 and the solenoid 38. The activated pump 30 extracts the concentrate or syrup from the container 22 and feeds the concentrate to the concentrate intake 32 of the spout 34. The activated solenoid 38 allows potable water in the ice water bath 24 to enter the water intake 40 of the spout.

The concentrate and water meet in a mixing block 46 in the spout 34, where the first mixing occurs. Typically, the mixing block 46 can not thoroughly mix a thick concentrate or syrup with water. The concentrate or syrup and water mixture in the mixing block 46 proceeds down the horizontal passage 48 towards the other end of the spout. In the passage 48, further mixing occurs when the mixture strikes the end 56 of insert 54 which extends into the passage 48. The engagement between the mixture and the end 56 generates turbulence.

Eventually, the mixture passes over the end 56, strikes the end wall of the passage 48 and is guided down by sloped face 70 of the first baffle 66(*l*) into the insert passage 60. The sloped face 70 helps to prevent a backup of the mixture in the horizontal passage 48. The backup of mixture could generate excessive pressures in the passage 48 which could cause damage, leaks or poor mixing.

Once in the passage 60, the mixture is subject to a substantial amount of mixing and churning which thoroughly mixes the mixture into the beverage. The baffles 66 are arranged in the passage 60 to prevent the mixture from flowing directly through. As the mixture goes down the passage 60, the mixture strikes each baffle 66. The repeated engagement of the mixture and the baffles 66 generates turbulence which mixes the mixture. Once the mixture has passed the bottom baffle 66, a thoroughly mixed beverage has been produced. After passing the bottom baffle 66, the mixture proceeds out the other end 64 of the passage 60 into the cup 44. Typically, the other end 64 of the passage 60 is smaller than the one end 62 to increase the velocity and guide the beverage as it is discharged into the cup 44.

Although the static mixing nozzle has been described with respect to post-mix dispenser, the nozzle may be used with pre-mix dispensers and any other application requiring one or more liquids to be mixed. In a pre-mix dispenser, the nozzle could remix a single liquid to eliminate any settling which may have occurred during storage.

Having now described one preferred embodiment of the present invention, it is now apparent to those skilled in the art that numerous other embodiments and modifications thereof are contemplated as falling within the scope of the present invention as defined by the appended claims.

What is claimed:

1. A beverage dispenser system comprising:

a potable water source for supplying potable water;

a concentrate container for storing a liquid; and a beverage discharge assembly including a mixing block that receives the liquid from the concentrate container and potable water from the potable water source;

a first passage interconnected with the mixing block having a first end and a second end, the first end receiving the liquid and potable water from the mixing block;

a nozzle defining a second passage having a first end adjacent the second end of the first passage, and a second end at a liquid-dispensing location; and an insert having an insert housing retained in the second passage, the insert housing defining an insert passage having a first inside diameter and a plurality of inwardly-directed baffles, the insert housing further defining a nozzle end located at the second end of the second passage, the nozzle end having a second inside diameter that is less than the first inside diameter for dispensing liquid therefrom.

2. The beverage dispenser system as set forth in claim 1, wherein said baffles are located on alternating sides of the insert housing in a staggered pattern down the insert housing, with each said baffle overlapping the adjacent said baffle to prevent a direct line flow through the insert housing.

3. The beverage dispenser system according to claim 1, wherein a portion of said insert housing extends from the second passage into the first passage so that said portion extends into a flow path of the water and the liquid along said first passage.

4. The beverage-dispenser system according to claim 1, wherein said insert housing is split along a long axis into halves with means for interlocking the halves together.

5. The beverage dispenser system as set forth in claim 1, wherein said second passage further comprises a nozzle passage housing, the nozzle passage housing being constructed and arranged to removably retain the insert housing within the nozzle passage housing.

6. The beverage dispenser system as set forth in claim 5, wherein a portion of the insert housing defining a top baffle with the sloped face extends from said second passage into the first passage.

7. The beverage dispenser system according to claim 6, wherein said nozzle passage housing has an alignment groove, and said insert housing has an alignment tab that mates with said alignment groove so that the nozzle passage housing and the insert housing are aligned and the sloped face baffle slopes in a downward direction from a side of the second passage toward the mixing block.

8. The beverage dispenser system as set forth in claim 5, wherein the insert includes a set of ridges located on the surface of said insert housing to permit said second passage to firmly maintain said insert, and to enable slidable removal of said insert from said second passage through said second end of said second passage when a force, in a downward direction, is applied to said insert.

9. A discharge assembly for mixing at least one stored liquid comprising:

a first passage having a first end and a second end, the first end being constructed and arranged to receive liquid a nozzle defining a nozzle passage having a first end adjacent the second end of the first passage, and a second end at a liquid-dispensing location; and an insert having an insert housing retained in the nozzle passage, the insert housing defining an insert passage having a first inside diameter and a plurality of inwardly-directed baffles, the insert housing defining a nozzle end located at the second end of the nozzle passage, the nozzle end having a second inside diameter that is less than the first inside diameter for dispensing liquid therefrom.

10. The discharge assembly as set forth in claim 9, wherein said baffles are located on alternating side of the insert housing in a staggered pattern down the insert housing with each said baffle overlapping the adjacent said baffle to prevent a direct line of flow through the insert housing.

11. The discharge assembly as set forth in claim 9, wherein said nozzle passage further comprises a nozzle passage housing, the nozzle passage housing being constructed and arranged to removably retain the insert housing within the nozzle passage housing.

12. The discharge assembly as set forth in claim 11, wherein a portion of the insert housing defining a top baffle with a sloped face extends from said nozzle passage into the first passage.

13. The discharge assembly as set forth in claim 12, wherein said insert housing is split along a long axis into halves with means for interlocking said halves together.

14. The discharge assembly as set forth in claim 12, wherein said nozzle passage housing has an alignment groove, said insert housing has an alignment tab that mates with said alignment groove so that said nozzle passage bossing and said insert housing are aligned and the sloped faced baffle slopes in a downward direction from a side of the nozzle passage toward the first passage.

15. The discharge assembly as set forth in claim 11, wherein said insert includes a set of ridge located on the surface of said insert housing to permit said nozzle passage to firmly maintain said insert, and to enable slidable removal of said insert from said nozzle passage when a force, in a downward direction, is applied to said insert.

16. The discharge assembly according to claim 9, wherein a portion of said insert housing extends from the nozzle passage into the first passage so that said portion extends into a flow-path of the liquid along said first passage.

17. A discharge assembly for mixing at least one stored liquid comprising:

a first passage having a first end, a second end, and an axis extending along the first passage, the first end being constructed and arranged to receive liquid;

a nozzle defining a second passage has a first end adjacent the second end of the first passage, a second end at a liquid dispensing location, and an axis extending along the second passage; and an insert having an insert housing defining an insert passage having a first inside diameter, and a plurality of inwardly-directed baffles and a top baffle with a sloped face, the top baffle being constructed and arranged to deflect the liquid from a direction along the axis of the first passage into the insert passage to a direction along the axis of the second passage, a portion of the insert housing defining the top baffle with the sloped face extending from the second passage into the first passage, the insert housing further defining a friction producing structure, and a nozzle end adjacent the second end of the second passage, the nozzle end having a second inside diameter that is less than the first inside diameter for dispersing liquid therefrom, the second passage defining inner walls that are constructed and arranged to removably retain the insert housing within the second passage by engaging the friction producing structure.

18. The discharge assembly as set forth in claim 17, wherein said insert housing is longer than said inner walls defined by the second passage so that the insert housing extends above the second passage and into the first passage and below the second passage when the insert is retained.

19. The discharge assembly as set forth in claim 18, wherein the portion of said insert housing extending into said first passage extends into a flow path of liquid along the first passage.

20. The discharge assembly as set forth in claim 18, wherein said insert housing is split along a long axis to form halves, with means for interlocking said halves together.

21. The discharge assembly as set forth in claim 17, wherein said nozzle has an alignment groove, said insert has an alignment tab, and said insert is positioned so that said alignment tab mates with said alignment groove wherein said nozzle and said insert are aligned so that the sloped faced baffle slopes in a downward direction from a side of the second passage toward the first passage.

22. The discharge assembly as set forth in claim 21, wherein said top baffle with the sloped face is positioned at the first end of the second passage, with said sloped faced baffle sloping in a downward direction from a side of the second passage toward a center of the second passage.

23. The discharge assembly as set forth in claim 22, wherein said top baffle faces said first passage to prevent buildup of liquid and pressure in the first passage.

24. The discharge assembly as set forth in claim 17, wherein said baffles are located on alternating sides of the insert housing in a staggered pattern down the insert housing, with each said baffle overlapping the adjacent said baffle to prevent a direct line of flow through the insert housing.

25. The beverage dispenser of claim 17, wherein the insert is constructed and arranged to be inserted and removed from the second open end of the second passage.

26. The discharge assembly as set forth in claim 25 wherein the insert includes a set of ridges located on the surface of the insert housing to permit the second passage to firmly maintain the insert housing, and to enable slidable removal of the insert from the second passage when a force, in a downward direction, is applied to the insert.

27. A discharge assembly comprising:

a nozzle defining a nozzle passage having an inlet end for receiving liquid and an outlet end opposite the inlet end; and an insert housing defining an inlet end, an outlet end, an insert passage and a plurality of baffles extending from an inside perimeter of walls of the insert housing toward a center of the insert passage, the inlet end of the insert housing being adjacent the inlet end of the nozzle passage and a portion of the outlet end of the insert housing further defining a nozzle end adjacent the outlet end of the nozzle passage, the nozzle end having an inside width thereacross that is less than an inside width of the walls of the insert housing, 28. The discharge assembly of claim 27, wherein the insert housing is constructed and arranged to be inserted into, retained by, and withdrawn from the nozzle passage through the outlet end.

29. The discharge assembly of claim 27, further including an upstream passage having a first end for receiving a liquid and a second and adjacent the inlet end of the nozzle passage.

30. The discharge assembly of claim 29, wherein the plurality of baffles includes a top baffle having a top side constructed and arranged to direct liquid from the upstream passage into the insert passage.

31. The discharge assembly of claim 30, wherein the plurality of baffles are disposed on alternating sides of the insert to prevent a direct line flow through the insert passage.

32. The discharge assembly of claim 31, wherein the insert is longer than the nozzle passage so that the inlet end of the insert extends above the nozzle passage and into the upstream passage and the outlet end of the insert extends below the nozzle passage when the insert is retained.

33. The discharge assembly of claim 27, wherein the insert housing includes two insert halves that are separable upon withdrawal from the nozzle passage.

34. The discharge assembly of claim 33, wherein the plurality of baffles are divided upon separation.

* * * * *